United States Patent [19]

Hilfiker

[11] Patent Number: 4,887,580

[45] Date of Patent: Dec. 19, 1989

[54] SUPERCHARGER DEVICE FOR RECIPROCATING INTERNAL COMBUSTION ENGINES, PARTICULARLY FOR MOTOR VEHICLES

[75] Inventor: Alfredo Hilfiker, Avigliana, Italy

[73] Assignee: Pneumofore S.P.A., Turin, Italy

[21] Appl. No.: 173,525

[22] Filed: Mar. 22, 1988

[30] Foreign Application Priority Data

Mar. 30, 1987 [IT] Italy ..... 67243 A/87
Sep. 11, 1987 [IT] Italy ..... 67773 A/87

[51] Int. Cl.[4] ..... F02B 33/36; F04C 29/10

[52] U.S. Cl. ..... 123/564; 418/23; 418/29

[58] Field of Search ..... 123/559.1, 564; 418/23

[56] References Cited

U.S. PATENT DOCUMENTS 2,696,790 12/1954 Crow ..... 418/23
4,472,119 9/1984 Roberts ..... 418/23
4,516,919 5/1985 Roberts ..... 418/23

FOREIGN PATENT DOCUMENTS 209629 10/1985 Japan ..... 123/564
23530 1/1987 Japan ..... 123/559.1
105394 9/1924 Switzerland ..... 123/564

*Primary Examiner*—Michael Koczo
*Attorney, Agent, or Firm*—Guido Modiano; Albert Josif

[57] ABSTRACT

Supercharger device for reciprocating internal combustion engines, particularly for motor vehicles, comprising, inserted on the induction manifold of the engine, a rotary positive-displacement supercharger driven constantly by the motor shaft, the capacity and therefore the delivery pressure whereof is variable from a minimum value to a maximum value and vice versa by virtue of the corresponding controlled variation of the geometry of the pumping means constituted by a stator cylinder, a rotor and vanes.

2 Claims, 4 Drawing Sheets

SUPERCHARGER DEVICE FOR RECIPROCATING INTERNAL COMBUSTION ENGINES, PARTICULARLY FOR MOTOR VEHICLES

BACKGROUND OF THE INVENTION

The present invention relates to a supercharger device for internal combustion engines, particularly for motor vehicles.

As is known, the maximum power of engines installed on motor vehicles, in particular on automobiles, considerably exceeds the power required during the normal use of the vehicle, the reserve power being used occasionally to achieve maximum acceleration, or maximum speed on level ground, the so-called top speed, or to climb the maximum slope.

In the normal use of the motor vehicle, the employed power generally does not exceed 50% of the maximum power and this reduction, obtained by choking the induction, is matched by a decrease of the specific performance of the engine with consequent high consumptions, imperfect combustion and therefore presence of polluting products in the exhaust system.

With the intention of improving the overall efficiency, the supercharging of endothermal reciprocating engines, both of the Otto-cycle type and of the Diesel-cycle type, has long been proposed, and consists of the compression to a greater-than-atmospheric pressure of all, or part of, the feed air before induction into the cylinders. Supercharging entails, as is known, an increase in mechanical efficiency, since the increase of the mechanical losses is much lower than the power increase, as well as an increase in volumetric efficiency and in actual thermal efficiency. This is followed by a considerable reduction in specific consumption, which can reach up to 45%.

Two types of supercharging are currently employed: the mechanical type and the exhaust-gas turbosupercharger type. The first type, used predominantly in small- and medium-cylinder capacity engines, draws the power required for supercharging from the driving shaft. Superchargers of the "Roots" type are used which are driven by the engine with the interposition of a multiplier and of a joint which starts the supercharger only at a preset number of rpm of the engine. In the second type of supercharging, reserved for engines with greater cylinder capacity, the supercharging power is supplied by a turbine which is driven by the exhaust gases of the engine, and drives a feed supercharger.

Both systems increase the maximum power of the engine but are substantially inactive at low rpm.

Their use therefore substantially improves the performance of the engine at medium and high rpm, but does not modify the power curve in terms of optimizing the power output with respect to the conditions of practical use of the motor vehicle.

SUMMARY OF THE INVENTION

The aim of the present invention is to provide a system for the controlled supercharging of reciprocating engines for motor vehicles, both of the "Otto" cycle type and of the "Diesel" cycle type, adapted to allow the abovesaid optimizing of power output with the consequent possibility of considerably reducing the cylinder capacities installed, achieving the peaks in required power by supercharging.

According to the present invention, in fact, a supercharger device for internal combustion reciprocating engines, particularly for motor vehicles is provided, comprising a positive displacement rotary supercharger inserted on the induction manifold of an engine, characterized in that said superchanger is constantly driven by the engine shaft, the capacity and therefore the delivery pressure of said supercharger being variable by virtue of a controlled variation of the geometry of pumping means of said supercharger, said pumping means comprising a stator cylinder, a rotor and vanes.

According to an embodiment of the invention, the geometry variation is obtained by varying, by virtue of the action of control elements, the eccentricity between the axis of the rotor and that of the stator.

In the zero-eccentricity configuration, the supercharger acts as a simple blower, and performs no supercharging action.

In the maximum-eccentricity configuration, the supercharger performs its maximum supercharging, the degree whereof depends on the maximum compression ratio between the induction and the delivery of the supercharger and the number of rpm being considered.

Since the supercharger is constantly driven, the passage from one condition to the other is immediate and the response to the demand of power increase by supercharging is correspondingly immediate since there are no delays due to startup inertia. Moreover, the passage from one condition to the other can be performed at any rpm rate of the engine, so that supercharging, and the consequent power increase, can also be performed at low rpm.

According to another embodiment of the present invention, the variation of the geometry of the pumping means is obtained by means of elements adapted to produce, upon the action of external control means, the retention of the vanes in the respective seats of the rotor. The passage from aspirated operation to supercharged operation of the engine therefore occurs by acting on said control elements to produce the retention or respectively the release of the vanes.

BRIEF DESCRIPTION OF THE DRAWINGS

Further characteristics, purposes and advantages of the invention will become apparent from the following detailed description and with reference to the accompanying drawings, given only by way of non-limitative example, wherein.

DESCRIPTION OF THE PREFERRED EMBODIMENTS

Figure 1:
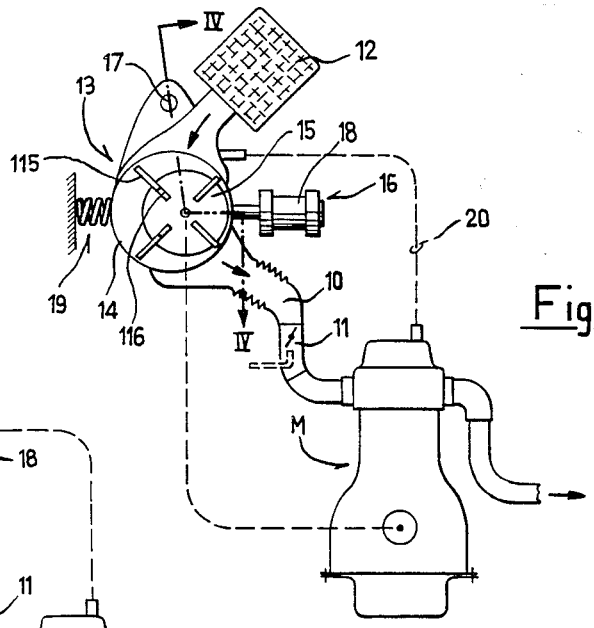
FIG. 1 is a schematic view of the system according to an embodiment of the present invention, wherein the geometry variation of the pumping means is obtained by varying the eccentricity between rotor and stator; the system being illustrated in the engine supercharging condition.

With reference to FIGS. 1 to 4, the letter M generally indicates an internal-combustion reciprocating engine, for example an "Otto" cycle engine, of the carburation type provided with an induction manifold 10 whereon is inserted a choke carburettor 11.

For a better understanding of the invention, the following characteristic engine data are considered:

cylinder capacity 1000 cc
power 37 KW at 5500 rpm
max torque 90 N.m at 3000 rpm

On the induction manifold 10 of the engine M, between the carburettor 11 and the filter 12, is inserted a positive-displacement rotary supercharger 13, of the known type comprising a stator 14 and an eccentric rotor 15 bearing a plurality of vanes 115, freely slideable in respective seats 116 of the rotor. In the present description the assembly constituted by the stator, by the rotor and by the vanes is briefly defined as pumping means.

According to the present invention, the geometry of the pumping means is variable, and in the illustrated example this is obtained by varying the eccentricity between the stator cylinder 14 and the rotor 15, by means of control elements 16, from zero to a maximum value which depends on the difference between the diameters of the stator and of the rotor. For this purpose the stator 14 is oscillably suspended from a pivoting pin 17 about which it can rotate to move with respect to the rotor 15, which is fixed, to pass from the maximum-eccentricity configuration illustrated in FIG. 1 to that of zero eccentricity illustrated in FIG. 2.

The control elements 16 may be of different types, for example they can be constituted by a hydraulic piston 18 acting in contrast with a spring 19, or they can be mechanical and either direct or power-assisted.

In the configuration of maximum eccentricity, illustrated in FIG. 1, the supercharger produces the maximum volumetric capacity and the maximum pressure, providing the maximum supercharging of the engine M at the number of rpm being considered. The volumetric capacity of the supercharger is in fact related to the number of rpm by the following relationship $$V = \frac{(D - d) + D^2 \cdot \pi - (d^2)}{4} \cdot L \cdot n \cdot \eta v$$

where D is the inner diameter of the cylinder 14, d is the outer diameter of the rotor 15, L is the axial length of the supercharger, n is the number of rpm being considered and $\eta_v$ is the volumetric efficiency.

Figure 3:
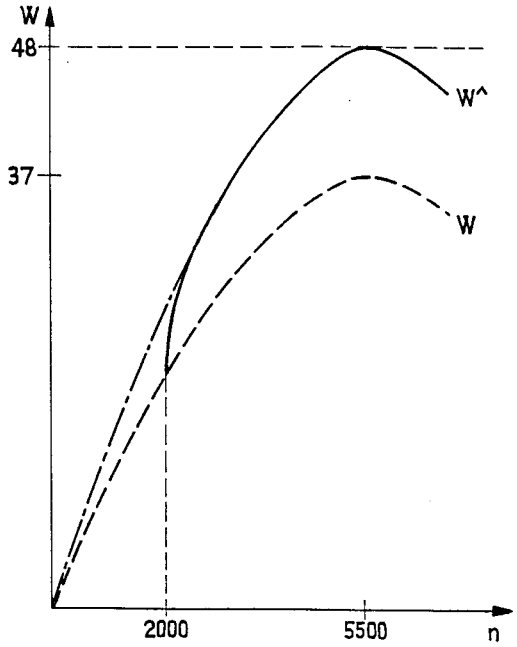
FIG. 3 is a diagram related to the engine of FIG. 1.

This supercharging corresponds to a variation in the power W as illustrated in the diagram of FIG. 3 wherein the insertion of the supercharging by shifting the cylinder 14 of the supercharger with respect to the rotor 15 occurs, for example, at 3500 rpm.

In the diagram, the broken-line curve W relates to the power of the engine M operating at atmospheric pressure, the curve W^ relates to the power of the same engine supercharged by the supercharger 13 and the solid connecting line between the two curves represents the power variation as a consequence of the insertion of the supercharger. The maximum power variation is closely related to the volumetric compression ratio of the supercharger 13 and for a value of 1/1.5 of said ratio it can be estimated, other conditions being equal, between 25% and 35% of the maximum power developed by the engine M with aspirated operation.

As is clearly illustrated in the qualitative diagram of FIG. 3, due to the characteristics of the vane supercharger 13, the compression ratio whereof is substantially independent from the rpm rate, the influence of supercharging is particularly considerable at low rpm, the increase in power being of the order of 30% already at 2000 rpm of the engine. Moreover, again due to the intrinsic characteristics of the positive-displacement rotary compressor 13, the increase in the temperature of the air due to supercharging is very modest (20–30% lower than the temperature increase caused by Roots superchargers) and this, together with the considerable turbulence caused by the supercharging, significantly reduces detonation phenomena.

Accordingly, the engine M with the supercharging system according to the invention may be advantageously fitted to motor vehicles requiring engines with approximately 20–30% higher power, since, in case of need, the power demand is met by inserting the supercharger 13 in the specified manner.

Figure 2:
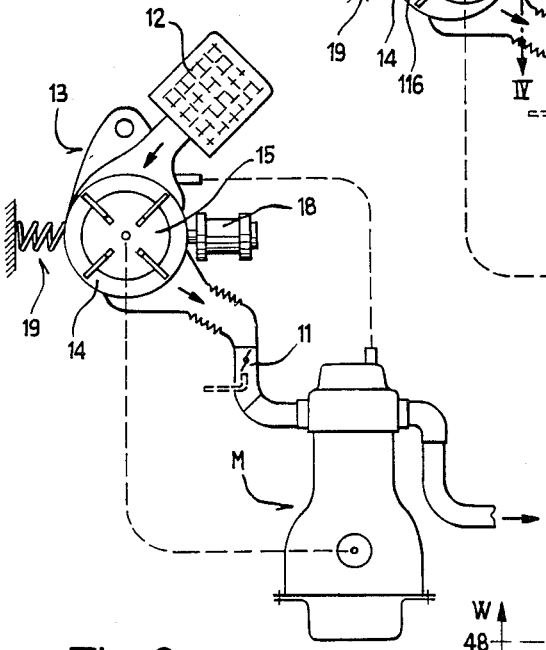
FIG. 2 is a similar schematic view illustrating the system at rest in conditions of non-supercharged operation of the engine.

In the idle configuration with zero eccentricity, illustrated in FIG. 2, the supercharger performs a simple ventilating effect, with a considerable increase in turbulence; the volumetric flow rate of the airflow supplied thereby, substantially at atmospheric pressure, being expressed by the following relation:

$$V = \frac{(D^2 - d^2)\pi}{4} \cdot L \cdot n \cdot \eta v$$

where the symbols have the previously specified meanings.

For this zero-eccentricity configuration, which is predominant in the ordinary use of the motor vehicle, the load on the supercharger is minimal and there is no relative movement of the vanes with respect to the recesses of the rotor, this in practice eliminating the need for adequate lubrication. For this purpose it is advantageous, and also sufficient, to bleed on the induction duct of the supercharger 13, for example by means of a duct 20, the oil vapors recycled from the engine M.

Figure 4:
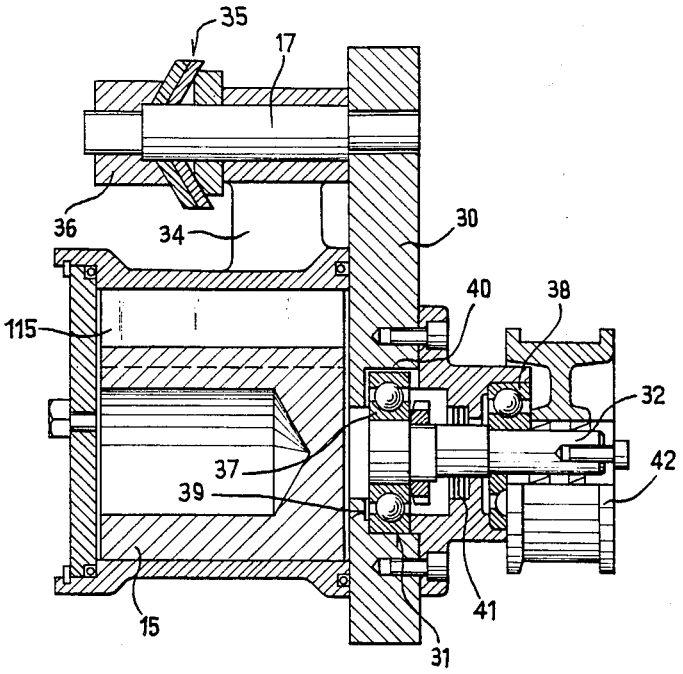
FIG. 4 is a sectional view of the supercharger taken along the line IV—IV of FIG. 1.

FIG. 4 illustrates an advantageous constructive embodiment of the supercharger 13.

According to this embodiment, a plate 30 has a seat 31 for supporting the shaft 32 of the rotor 15. The plate 30 has a perfectly planar surface 33 facing towards the stator cylinder 14 which is oscillably supported by an arm 34 articulated to the pivot 17 rigidly associated with the plate 30. A series of elastic washers 35, engaged by a locking nut 36, keeps the stator cylinder 14 in sealing contact engagement against the surface of the plate 30; the seal being ensured by an "O"-type gasket accommodated in a front recess of the cylinder. The shaft 32 of the rotor 15 is supported by a first bearing and by a second bearing, respectively 37 and 38. In order to avoid axial stresses on the first bearing 37, its two faces are subject to the same pressure by virtue of the presence of a front recess 39 and of axial ducts 40 provided on the plate 30; the seal being ensured, downstream with respect to the bearing, by a gasket 41 acting on the shaft. A pulley 42 is keyed onto the protruding end of the shaft to transmit to the rotor 15 the power drawn from the shaft of the engine M.

Figure 5:
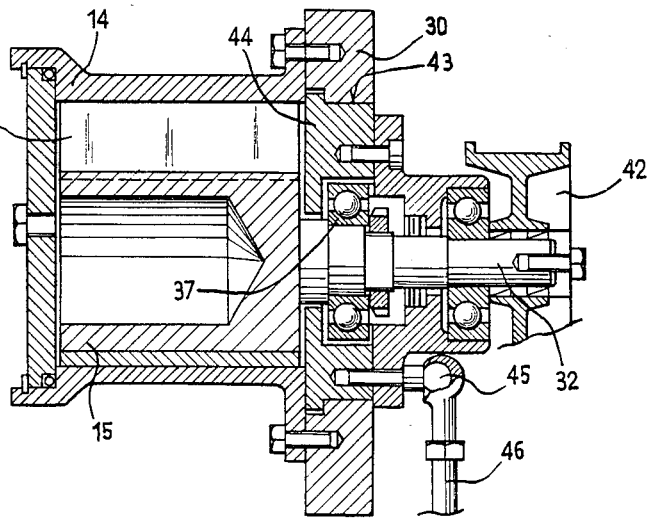
FIG. 5 is a sectional view, similar to the previous one, illustrating a supercharger according to a variated aspect of the invention.

FIG. 5 shows a superchanger, according to a further aspect of the invention and which differs from the one previously described in that the stator cylinder is flanged directly onto the plate 30 having a through seat 43 which is circular but eccentric with respect to the cylinder 14 wherein a bush 44 is accommodated, freely rotatable, and is eccentrically provided with the bearing 37 for supporting the shaft 32.

The eccentricity of the bush 44, with respect to the cylinder 14, is identical to that of the shaft 32 with respect to the bush, so that, by rotating through 180° the bush 44 is the seat of the plate 30, the two eccentricities compensate one another and the rotor 15 arranges itself coaxial to the cylinder 14. A pivot 45 is provided on the bush 44 to allow the connection of a tensioning element 46 adapted to produce the rotation of said bush in its seat.

FIGS. 6–11 show a supercharger, according to another aspect of the invention, in which the variation of the geometry of the pumping means is obtained by subjecting the vanes 115 of the rotor to elements adapted to produce, upon the action of an external control K, the retention of said vanes in the respective seats 116 of the rotor.

Figure 6:
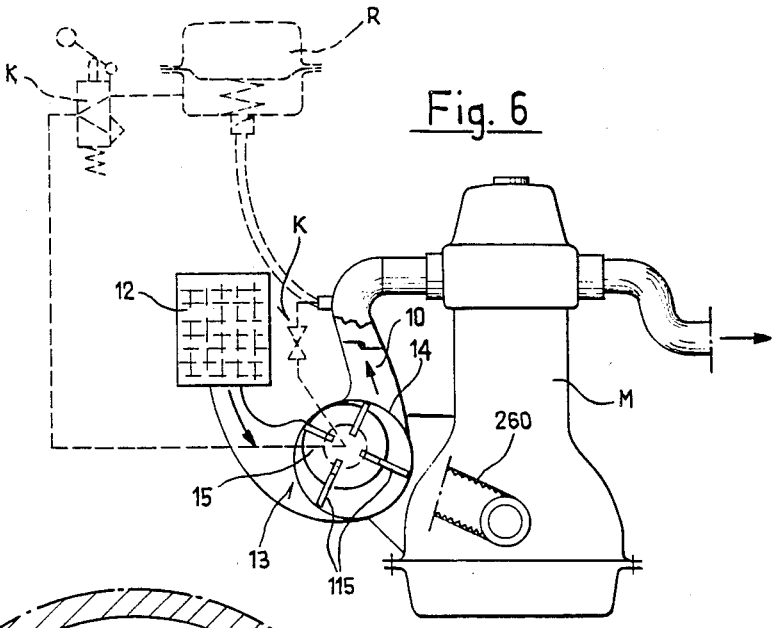
FIG. 6 is a schematic view, similar to FIG. 1, illustrating another embodiment of the present invention in which the geometry variation of the pumping means is obtained by retention of the vanes.
Figure 7:
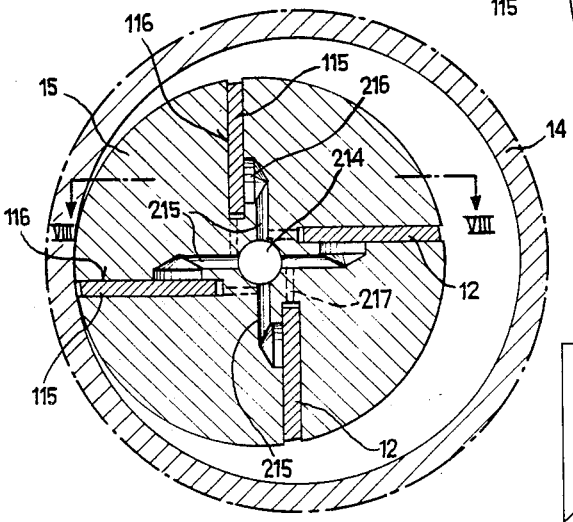
FIG. 7 is a transverse sectional view of a supercharger with pneumatic means for the retention of the vanes according to FIG. 6.
Figure 8:
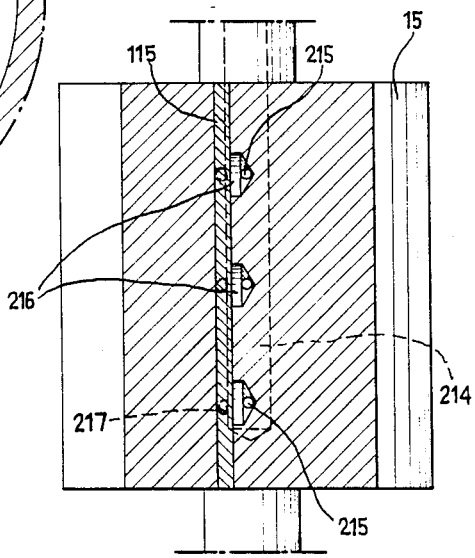
FIG. 8 is an axial sectional view of the rotor taken along the line VIII—VIII of FIG. 7.

In the embodiment illustrated in FIGS. 6 and 7, the rotor is provided with elements for retention by negative pressure, comprising an axial channel 214 connectable to a negative pressure source and a plurality of derived channels 215, axially spaced (FIG. 8), adapted to subject the vanes 115 to said negative pressure to keep then fully inserted in their seats 116. As illustrated in FIG. 6, the negative pressure source may be constituted by the induction manifold 10 of the engine M which is connected to, or disconnected from, the duct 214 by means of the valve K constituting the external control. If required, the action of the induction manifold may be integrated with an accumulation container R and/or with an auxiliary negative pressure source, for example constituted by an ejector associated with the exhaust manifold and also by temporarily using the supercharger as vacuum pump.

Each of the derived channels 215 ends with a widened aspiration inlet 216 which faces the lateral wall of the respective vane seat 115. In this manner, when the channel 214 is connected to the negative pressure source, each vane, as an effect of the negative pressure, is aspirated and drawn in forced contact engagement against said wall of its seat and, by virtue of the friction, is retained inside said seat after it has been pushed therein by the contact with the stator as an effect of the rotation of the rotor. To increase the described sealing action, it may be convenient to provide auxiliary derived channels 217 which lead onto the dead bottom of the seats 115 and act by direct aspiration on the related vane. The channels 217 are in any case indispensable to ensure the correct operation of the supercharger at high rpm in view of the need to rapidly evacuate the air which is on the bottom of the vane seat.

Figure 9:
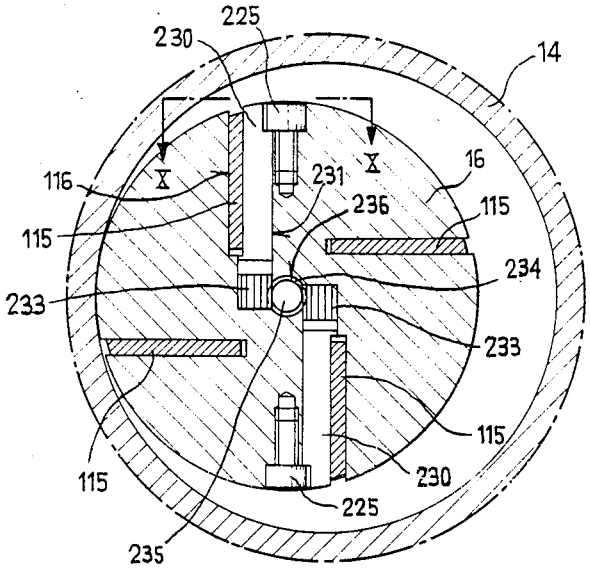
FIG. 9 is a sectional view, similar to FIG. 7, illustrating a supercharger with mechanical vane retention means, according to a further aspect of the invention.
Figure 10:
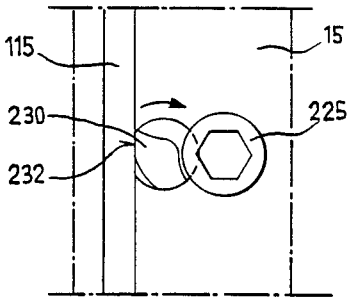
FIG. 10 is a sectional view taken along the line X—X of FIG. 9.

According to a further aspect of the invention as shown in FIGS. 9 and 10, the vanes 115 are subject to the action of mechanical retention elements constituted by cylindrical cams 230 rotatably contained in corresponding cylindrical seats 231 communicating with the seats 116 and retained therein by retention screws 225. The lower end of each cam 230, the active surface 232 whereof is profiled for example as illustrated in FIG. 10, is provided with a toothed portion 233 engaging with the corresponding toothed portion 234, for example in the shape of a cylindrical rack, or of an endless screw, of a control shaft 235 slideable and/or rotatable in an axial seat 236 of the rotor 10. The small shaft 235 is subject to a control, coherent with the type of the sets of teeth 233–234 which may be mechanical or fluidodynamic and the actuation whereof moves the cams 230 angularly to engage or disengage their active surfaces 232 with or from the lateral face of the related vane 115.

Figure 11:
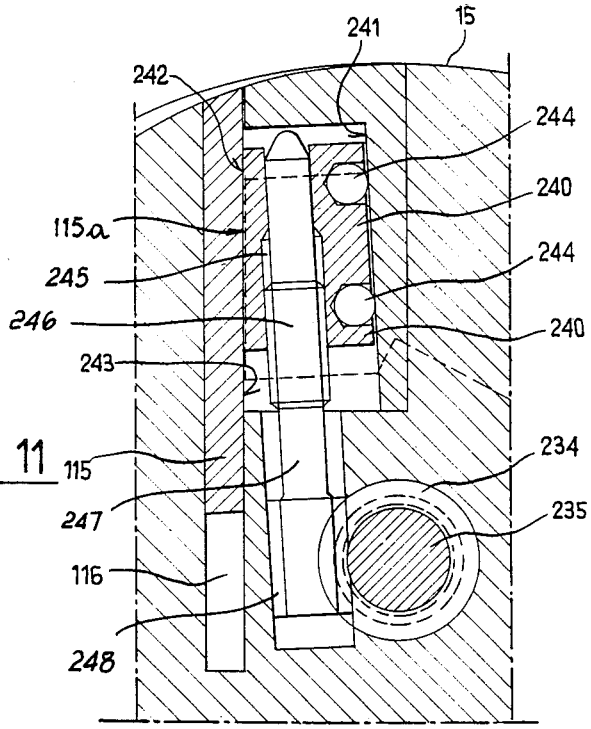
FIG. 11 is a partial sectional view, in enlarged scale, of a rotor, with mechanical retention means, according to another aspect of the invention.

Referring to FIG. 11, the cylindrical cams are replaced by wedge-shaped radial blocks 240 slideable in corresponding wedge-shaped radial seats 241 provided on the rotor 15. As visible in FIG. 11 the wedge-receiving radial seats 241 taper in the centrifugal direction of the seat. The blocks 240 have a wedge-shaped surface 242 intended to make contact with the lateral surface 115*a* of the corresponding vane 115 through a slot 243 which connects the seats 116 and 241. Each block 240 is subject to the action of the centrifugal force which pushes the wedge-shaped surface 242 against the lateral surface of the vane 115 to retain the vane and is provided with a threaded hole 245 in which the correspondingly threaded portion 246 of a return shaft 247 engages.

The other end of the shaft 247, opposite to the threaded portion 246, has a pinion 248 engaging with the toothed portion 234 of the control shaft 235 described with reference to the previous FIG. 9. It is obvious that the rotation of the shaft 235 causes a radial movement of the wedge-shaped block 240 which, depending on the direction of rotation imparted to the shaft, moves, pushed by the centrifugal force, to engage the vane 115 or, against the action of said force, to disengage it; the control being extremely gradual, to the advantage of a controlled release of the vanes.

The supercharger as illustrated in FIGS. 6 to 11 substantially has the following advantages:

- the rotor, the eccentricity whereof with respect to the stator is fixed and constant, may be supported at both ends and therefore is not subject to limitations in axial extension with the consequence that, with equal delivered power, the diameter can be reduced and the peripheral speed of the vanes during supercharging can be reduced accordingly;
- in idle operation, predominant in use, there is no contact between the vanes and the stator cylinder so that the heating of the air and the wear of the vanes are avoided;
- the rotor of the supercharger may be used as dynamic balancing shaft of the engine or at least as integrating element of said shaft.

The rotor is keyed, directly or by transmission means such as gears, or chains, or toothed belts 260, and, besides having a compact configuration, allows to angularly time the rotor and the shaft of the engine to synchronize the pressure waves caused by each vane with the filling phase of each cylinder, thus increasing the degree of filling of the cylinder, especially at low rpm, as an effect of the additional dynamic pressure.

Furthermore, by adopting a transmission element constituted by a pair of cylindrical gears, the rotor 10 is counter-rotating with respect to the driving shaft and can therefore be sized and counterweighted so as to also perform the function of dynamic balancing shaft. In particular in an in-line two-cylinder four-stroke engine, the rotor of the supercharger, if counterrotating and at equal rpm with the engine, can balance the inertial forces due to the first-order harmonics.

Naturally, the concept of the invention being invariant, the details of the execution and the embodiments may be widely varied, with respect to what is described and illustrated by way of non-limitative example, without thereby abandoning the scope of the invention.

I claim:

1. Supercharger device for internal combustion reciprocating engines, particularly for motor vehicles, comprising a positive displacement rotary supercharger inserted on the induction manifold of an engine, wherein said supercharger is constantly driven by the engine shaft, the capacity and therefore the delivery pressure of said supercharger being variable by virtue of a controlled variation of the geometry of pumping means of said supercharger, said pumping means comprising a stator cylinder, a rotor and vanes, wherein the variation of the geometry of the pumping means is obtained by means of elements adapted to produce, upon the action of control means, the retention of the vanes in the respective seats of the rotor, whereby the rotor of the compressor is angularly timed with the engine shaft to synchronize the pulses of the supercharger with the induction phase of said engine to improve the filling coefficient, wherein the rotor of the supercharger is provided with mechanical vane retention means, wherein the mechanical vane retention means are constituted by wedge-shaped radial blocks, slideable in corresponding wedge-receiving seats provided on the rotor and wherein each block is provided with a wedge-shaped surface intended to engage, as an effect of the centrifugal force, the lateral surface of the corresponding vane; positive control means being provided to gradually disengage said blocks from said lateral surfaces of the vane wherein said positive control means comprise, for each block, a shaft having a threaded end engaging in a correspondingly threaded hole of the block; the other end of the return shaft being provided with a pinion engaging with the complementarily toothed portion of a control shaft, coaxial to the rotor, the rotation whereof corresponds to a respective engagement or disengagement motion of the block with or from the vane.

2. Supercharger device for internal combustion reciprocating engines, particularly for motor vehicles, comprising a rotary supercharger inserted on the induction manifold of an engine, wherein said supercharger is constantly driven by the engine shaft and includes controllable pumping means, said pumping means comprising a stator cylinder, a rotor and vanes, said rotor having radially extending seats for said vanes arranged slidably within said seats and mechanical vane retention means for the retention of the vanes in said radially extending seats of the rotor, said mechanical vane retention means comprising a lateral engagement surface on said vanes, wedge-receiving seats in said rotor and tapering in the centrifugal direction of said rotor, said wedge-receiving seats being adjacent to said radially extending seats, a radial lateral slot between each pair of said adjacent radially extending seats and said wedge-receiving seats to provide communication therebetween, wedge-shaped radial blocks slideable in said wedge-receiving seats and wherein each said block has a wedge-shaped surface facing said lateral engagement surfaces of each of said vanes through said slot to engage therewith as an effect of the centrifugal force urging radially outwards said wedge-shaped radial blocks and positive control means to controllably disengage said blocks from said lateral surfaces of the vane.

* * * * *